United States Patent [19]

Ortiz

[11] 3,959,918

[45] June 1, 1976

[54] AIRBORNE TOY

[75] Inventor: Nilson Ortiz, San Francisco, Calif.

[73] Assignee: Niltec Corporation, San Francisco, Calif.

[22] Filed: Nov. 7, 1974

[21] Appl. No.: 521,824

[52] U.S. Cl. ..... 46/86 R; 46/74 D
[51] Int. Cl.[2] ..... A63H 33/20
[58] Field of Search ..... 46/74 D, 86; 273/106

[56] References Cited

UNITED STATES PATENTS 1,803,506 5/1931 McDonough ..... 46/86 A 1,867,714 7/1932 Shippee et al. ..... 46/86 A

*Primary Examiner*—Louis G. Mancene
*Assistant Examiner*—Robert F. Cutting
*Attorney, Agent, or Firm*—Robert K. Rhea

[57] ABSTRACT

An airborne toy comprising a substantially diamond-shaped planar base having an outstanding longitudinal and a transverse rib secured to one of its surfaces is provided with a well formed at the intersection of the ribs for releasably containing, by hinged doors, a toy parachute for lowering the toy to the surface of the earth.

1 Claim, 4 Drawing Figures

AIRBORNE TOY

BACKGROUND OF THE INVENTION

Field of the invention.

The present invention relates to toys and more particularly to a toy to be airborne when thrown upwardly into the air.

SUMMARY OF THE INVENTION

A generally diamond-shaped planar base, formed of lightweight material, is provided with a longitudinal and a transverse outstanding rib on one of its surfaces, similarly formed of light-weight material, and recessed at their intersection to form a box-like well. Hingedly connected flap-like doors normally close the well which, prior to using the toy, contains a rolled up toy parachute attached to the base. The parachute being released when the toy reaches the upward limit or apex of its flight, after being thrown into the air, and unfolds and gradually lowers the toy to the surface of the earth.

The principal object is to provide an amusement toy which may be thrown upwardly into the air in a spinning or rotating motion about its central axis for subsequent release of a parachute to lower the toy to the surface of the earth.

DESCRIPTION OF THE PREFERRED EMBODIMENT

Figure 1:
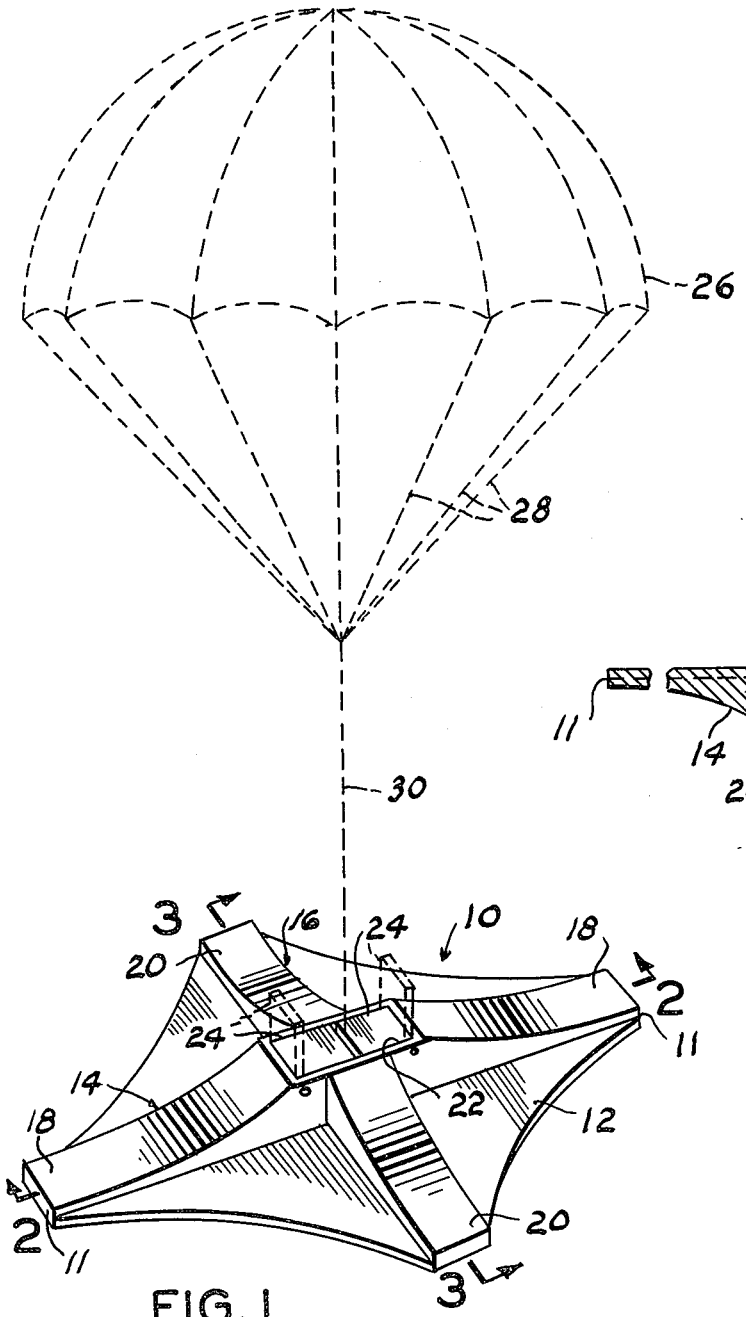
FIG. 1 is a perspective view of the toy illustrating, by dotted lines, the parachute retaining doors in opened position and the parachute inflated.

Like characters of reference designate like parts in those figures of the drawings in which they occur.

In the drawings:

The reference numeral 10 indicates the toy, as a whole, which is substantially planar diamond-shaped in general configuration to form handle-like ends 11. The toy is formed by a flat base 12 having a longitudinal rib 14 and a transverse rib 16 secured to one of its surfaces in intersecting relation. Each of the ribs 14 and 16 form base stiffeners and are characterized by a width greater than their thickness at their respective end portions 18 and 20 with the thickness gradually increasing in an arcuate curve outwardly from adjacent the surface of the base so that where the ribs intersect the rib thickness is substantially equal to the width. At the point of intersection of the ribs the longitudinal rib 14 is longitudinally recessed or hollowed out between its side surfaces to form a rectangular box-like opening 22 well outward opposite the base 12. The respective ends of the well 22 are provided with a pair of flap doors 24 hingedly connected to the longitudinal rib 14 for opening and closing the well 22.

A toy parachute 26 has its shroud lines 28 connected with an anchor cord 30 secured at its other end to an eyelet or ring 32 attached to the base 12 within the well 22.

OPERATION

Figure 4:
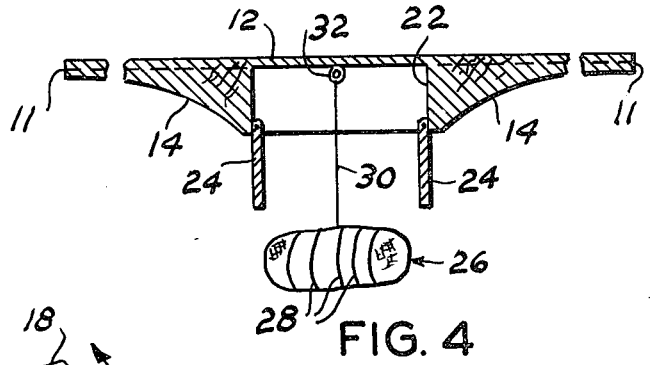
Figure 2:
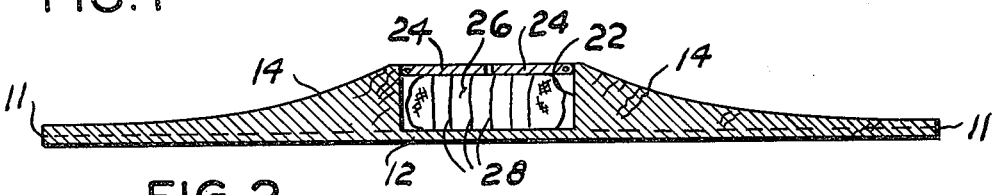
FIGS. 2 and 3 are vertical cross sectional views, partially in elevation, taken respectively along the lines 2—2 and 3—3 of FIG. 1; and, FIG. 4 is a fragmentary vertical cross sectional view illustrating the toy in inverted airborne parachute releasing position.
Figure 3:
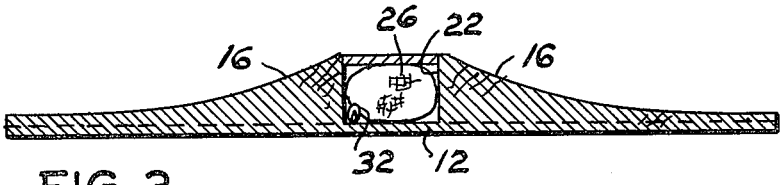

In operation the toy parachute is collapsed and rolled to form a configuration at least freely received by the well 22 with the parachute shroud lines 28 preferably wrapped around the parachute. The rolled up parachute 26 is placed within the well 22 and the flap doors 4 closed. One end portion of the device 10 is then grasped by the fingers and thrown upwardly into the air preferably by imparting a spinning motion to the device and with the doors 24 preferably disposed upwardly. This action produces a spinning motion of the toy about the central axis of the base in which the doors 24 alternately open and close. When the toy reaches the limit of its upward flight, it may fall back toward the launcher and usually becomes inverted, to the position shown by FIG. 4, wherein the flap doors 24 are opened by gravity and pressure of the parachute thus allowing the parachute to fall out of the well, unroll and inflate, to the position shown by dotted lines (FIG. 1), which gradually lowers the toy to the earth.

Obviously the invention is susceptible to changes or alterations without defeating its practicability, therefore, I do not wish to be confined to the preferred embodiment shown in the drawings and described herein.

I claim:

1. In an aerial toy in combination with a collapsible toy parachute having shroud lines secured to the toy, the improvement comprising:

- a flat base having opposing end portions forming handles adapted for use in throwing said base into the air;
- a longitudinal rib extending between said end portions and secured to said base;
- a transverse rib intersecting said longitudinal rib,
  - said ribs each having a thickened portion at their point of intersection,
  - said longitudinal rib having a recess in its thickened portion forming a well for nesting said parachute when in a collapsed condition; and,
- a normally closed flap door loosely connected with one of said ribs for opening the well and releasing said toy parachute while said toy is airborne.

* * * * *